US006321698B1

(12) United States Patent
Rau et al.

(10) Patent No.: US 6,321,698 B1
(45) Date of Patent: Nov. 27, 2001

(54) INTERNAL COMBUSTION ENGINE

(75) Inventors: Erhard Rau, Weilheim; Wilhelm Huettner, Waiblingen; Joerg Abthoff, Pluederhausen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/369,225

(22) Filed: Aug. 5, 1999

Related U.S. Application Data

(60) Provisional application No. 60/095,774, filed on Aug. 7, 1998.

(51) Int. Cl.[7] ..... F02B 75/22
(52) U.S. Cl. ..... 123/54.4
(58) Field of Search ..... 123/54.1, 54.4, 123/54.8, 55.1, 54.6, 54.7, 54.2

(56) References Cited

U.S. PATENT DOCUMENTS 2,927,565 * 3/1960 Turner ..... 123/54.4
2,929,368 * 3/1960 Payne ..... 123/54.4
2,990,819 * 7/1961 Bouvy ..... 123/54.4
5,937,804 * 8/1999 Kaminski ..... 123/54.7

FOREIGN PATENT DOCUMENTS

413933A * 8/1910 (FR) ..... 123/55.1
1024825 * 4/1953 (FR) .
121605A * 5/1919 (GB) ..... 123/55.1
97/40267 * 10/1997 (WO) ..... 75/22

OTHER PUBLICATIONS

"18–Zylinder von Volkswagen", Autos Test Technik, mot No. 11, ISSN 0027–1462, pp. 16–23, (May 15, 1998).

* cited by examiner

*Primary Examiner*—Noah P. Kamen
*Assistant Examiner*—Hai Huynh
(74) *Attorney, Agent, or Firm*—Kenyon & Kenyon

(57) ABSTRACT

An internal combustion engine having four individual cylinder banks, in each case two cylinder banks being arranged in a V-shape with respect to one another in such a way that the cylinder banks forming a V are disposed on both sides of one engine plane E defined by a vertical axis H that symmetrically divides the internal combustion engine and by a longitudinal axis L of the internal combustion engine, one cylinder bank of the cylinder banks that are associated with one another in a V-shape being configured closer to the engine plane E or the vertical axis H than the cylinder bank that is diametrically opposed with respect to the engine plane E. The present invention is intended for use in mixture-compressing internal combustion engines having externally supplied ignition, but also for air-compressing, self-ignition internal combustion engines.

2 Claims, 1 Drawing Sheet

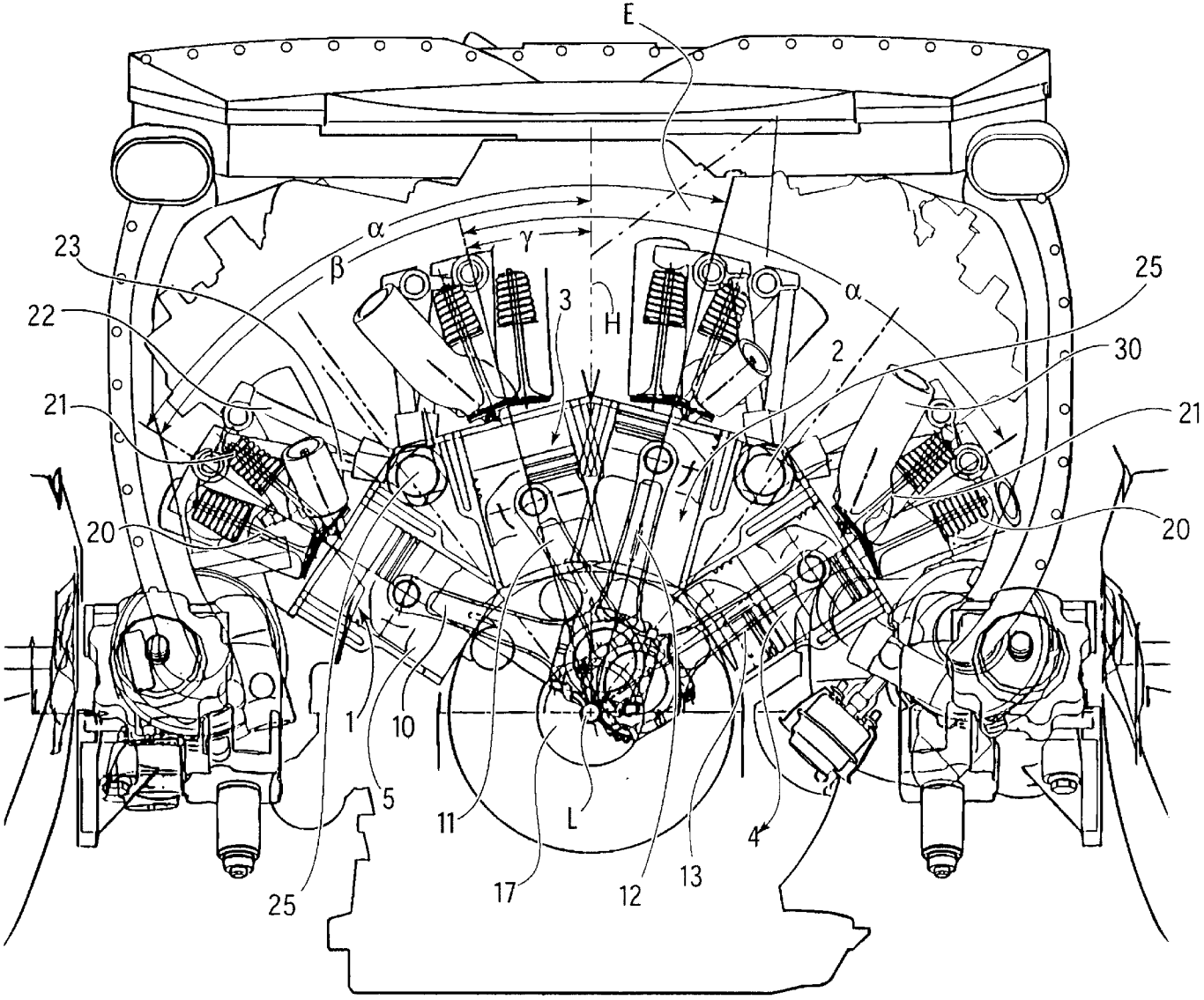
25
30
21
20
α
2
4
13
12
E
H
3
γ
L
17
11
10
5
1
25
α
β
23
22
21
20

INTERNAL COMBUSTION ENGINE

This application claims benefit of provisional application No. 60,095,774 filed Aug. 7, 1998

FIELD OF THE INVENTION

The invention relates to an internal combustion engine having four cylinder banks arranged in a double-V configuration.

RELATED TECHNOLOGY

The article "18-Zylinder von Volkswagen" (18-Cylinder by Volkswagen) in Autos Test Technik (Auto Test Technology), mot, no. 11, ISSN 0027-1462, pages 16 to 23, (May 15, 1998) discloses an internal combustion engine which has eighteen cylinders that are accommodated in three cylinder banks. Each cylinder bank accommodates six pistons. Four gas exchange valves per cylinder are controlled via six camshafts located above. Eighteen connecting rods are received by a crankshaft, three connecting rods engaging with one crankshaft throw. The three cylinder banks are manufactured as an integrally cast aluminum part. The complex geometry of this part makes a casting operation very costly. The three cylinder banks are configured radially, one vertical cylinder bank being bisected by a plane of the internal combustion engine defined by a vertical axis and a longitudinal axis of the internal combustion engine. The other two cylinder banks are configured symmetrically to the engine plane. Since there are only three cylinder banks, a relatively large number of pistons must be accommodated in one cylinder bank. This results in large dimensions in the longitudinal direction, the consequence being, on the one hand, a relatively substantial weight of the internal combustion engine and, on the other hand, unfavorable crash performance due to long front ends of the automobile body.

SUMMARY OF THE INVENTION

The present invention provides an internal combustion engine comprising a plurality of cylinders, which are divided into cylinder banks, comprising at least one camshaft for controlling at least two gas exchange valves provided per cylinder, and comprising a crankshaft for receiving corresponding connecting rods. Four individual cylinder banks (1, 2, 3, 4) are provided, with two cylinder banks (1, 2 or 3, 4) being arranged in a V-shape with respect to one another in such a way that the cylinder banks (1, 2 or 3, 4) forming a V are configured on both sides of one engine plane E. One cylinder bank (2 or 3) of the cylinder banks (1, 2 or 3, 4) that are associated with one another in a V-shape is configured closer to the engine plane E than the cylinder bank (1 or 4) that is diametrically opposed with respect to the engine plane E.

In contrast to prior designs, the internal combustion engine of the present invention has the advantage of a more compact design with a relatively low weight in terms of the size of the internal combustion engine and its number of cylinders. Also advantageous, moreover, is the fact that only a short front end of the automobile body is required for the internal combustion engine, resulting in a favorable crash performance. Especially beneficial, particularly given a cylinder number of twenty or more, is the attainable running smoothness for the internal combustion engine. The benefit of a simplified cylinder-head manufacturing is also derived from the design of four individual cylinder banks.

BRIEF DESCRIPTION OF THE DRAWINGS

An exemplary embodiment of the present invention is elucidated in the following description and shown in a simplified version in the drawing, in which:

FIG. 1 shows a schematic cross-sectional partial view of an embodiment of an internal combustion engine of the present invention.

DETAILED DESCRIPTION

Illustrated in cross-section in the drawing is a partial view of an internal combustion engine having four cylinder banks 1, 2, 3, 4. The internal combustion engine can be a mixture-compressing internal combustion engine having externally supplied ignition, or also an air-compressing, self-ignition internal combustion engine. Accommodated in each cylinder bank 1, 2, 3, 4 is at least one piston 5. Thus, designs are possible having four, eight, twelve, sixteen, twenty, twenty-four or more pistons 5 or cylinders. Provision is made in the exemplary embodiment for twenty cylinders, so that a cylinder bank 1, 2, 3, 4 contains, correspondingly, five pistons 5.

Two cylinder banks 1, 2 and 3, 4 are each arranged in a V-shape, forming a double-V configuration. It turns out that when twenty or twenty-four cylinders are used, a V-configuration is advantageous where cylinder banks 1, 2 or 3, 4 form an angle $\alpha$ of about 72 degrees. When working with an internal combustion engine having twelve or sixteen cylinders, an angle $\alpha$ of about 90 degrees turns out to be beneficial.

External cylinder banks 1, 4, and internal cylinder banks 2, 3 are arranged symmetrically to a vertical axis H, which divides the internal combustion engine into two uniform halves. Vertical axis H and a longitudinal axis L, which in the drawing is perpendicular to vertical axis H and extends into the drawing plane, define an engine plane E that is indicated in perspective view in the drawing. According to the present invention, the configuration of cylinder banks 1, 2, 3, 4 is such that in each case one cylinder bank 2 or 3 of a corresponding V-arrangement 1, 2 or 3, 4 is disposed closer to engine plane E than the its corresponding diametrically opposed outer cylinder bank 1 or 4. The result in the area of vertical axis H is that the two inner cylinder banks 2, 3 run at a relatively narrow distance from one another. As a result, an especially compact and, thus, light design of the internal combustion engine is rendered possible. An angle $\gamma$ formed between vertical axis H and inner cylinder bank 2 or 3 is, for example, 15 degrees. On the other hand, the diametrically opposed, external cylinder banks 1, 4 show a greater distance to engine plane E than do inner cylinder banks 2, 3, an angle $\beta$ of, for example, 57 degrees being formed by vertical axis 11 to external cylinder bank 1 or 4.

Visible in section are four connecting rods 10, 11, 12, 13, which are secured to throws (offset bends) of a crankshaft 17, at least two connecting rods 10, 12 or 11, 13 of a V-arrangement of cylinder banks 1, 2 or 3, 4 being mounted on a shared throw. Another possibility consists in providing offset (staggered) crank pins on the crankshaft, so-called split pins, which are needed to compensate for an ignition offset (ignition point discrepancy) when working with the V-arrangement of two pistons on one shared crank pin of crankshaft 17.

The internal combustion engine has at least two gas exchange valves 20, 21 per cylinder; provision is preferably made for four gas exchange valves. Gas exchange valves 20, 21 are controlled via push rods 22, 23, which each lead to a camshaft 25. Provision is made in the exemplary embodiment for two camshafts 25, which are accommodated in the available interspace between inner cylinder banks 2, 3 and outer cylinder banks 1, 4 and, viewed in the radial direction from crankshaft 17, are disposed somewhat below gas exchange valves 20, 21, thus closer to crankshaft 17.

The hot exhaust gases are carried away from gas exchange valves 21 via exhaust pipes 30, which, as shown in the drawing, run above the cylinders or cylinder banks 1, 2, 3, 4. Viewed in a clockwise direction, the arrangement of intake valves 20 and exhaust valves 21 is as follows:

beginning with cylinder 1 or cylinder bank 1, first intake valve 20, then exhaust valve 21;

for cylinder 3 or cylinder bank 3, following in the clockwise direction, exhaust valve 21, then intake valve 20;

for cylinder 2 or cylinder bank 2, continuing in the clockwise direction, intake valve 20, then exhaust valve 21;

for cylinder 4 or cylinder bank 4, continuing in the clockwise direction, first exhaust valve 21, then intake valve 20.

Also possible, however, is the following arrangement of intake valves 20 and exhaust valves 21, viewed in a clockwise direction:

beginning with cylinder 1 or cylinder bank 1, first exhaust valve 21, then intake valve 20;

for cylinder 3 or cylinder bank 3, following in the clockwise direction, then exhaust valve 21;

for cylinder 2 or cylinder bank 2, continuing in the clockwise direction, exhaust valve 21, then intake valve 20;

for cylinder 4 or cylinder bank 4, continuing in the clockwise direction, first intake valve 20, then exhaust valve 21.

The following dimensional sizes have proven to be especially effective for the construction of an internal combustion engine:

For an internal combustion engine, which, as indicated in the exemplary embodiment, has twenty cylinders, provision is made, for example, for eleven main bearings for supporting the crankshaft. The result is an overall length for the internal combustion engine of about 800 mm. When a connecting rod of a 12 mm width is used, the distance between cylinders is approximately 136 mm; the cylinder banks are to be offset by 12 to 56 mm. The ignition intervals are to be provided at 36—36—36—36 degrees.

In a design that uses crank pins for the crankshaft that are offset by six degrees (a so-called split-pin), six main bearings are needed to support the crankshaft. Thus, an overall length of about 690 mm results for the internal combustion engine. When working with a connecting rod of 12 mm width, the distance between cylinders is about 108 mm; the cylinder banks are to be offset by 12 to 13.5 mm. The ignition intervals are to be provided at 36—36—36—36 degrees.

In a design that includes twenty-four cylinders and 4×12 mm connecting rods per crank pin, a crank pin having a triple offset of 12, 24 and 12 degrees is necessary (a so-called three split-pin division of the crank pin). Seven main bearings are required to support the crankshaft. The result is an overall length of about 760 mm for the internal combustion engine. When a connecting rod of a 12 mm width is used, the distance between cylinders is approximately 108 mm; the cylinder bank offset is 13.5 mm. The ignition intervals are to be provided at 30—30—30—30 degrees.

What is claimed is:

1. An internal combustion engine having a central engine plane, comprising:

a plurality of cylinders arranged in a first, a second, a third and a fourth individual cylinder bank, each of the plurality of cylinders having at least two valves, the first and second cylinder banks being arranged in a first V-shape about the engine plane and the third and fourth cylinder banks being arranged in a second V-shape about the engine plane, with the second cylinder bank being closer to the engine plane than the first cylinder bank;

at least one camshaft for controlling the at least two valves of the plurality of cylinders; and a crankshaft for receiving rods connected to the plurality of cylinders;

wherein the at least one camshaft includes a first camshaft disposed on one side of the engine plane and a second camshaft disposed on another side of the engine plane; and wherein the first camshaft is accommodated in an interspace between the second and fourth cylinder banks and the second camshaft is accommodated in an interspace between the first and third cylinder banks, the first and second camshafts being disposed below the at least two gas exchange valves.

2. An internal combustion engine having a central engine plane, comprising:

a plurality of cylinders arranged in a first, a second, a third and a fourth individual cylinder bank, each of the plurality of cylinders having at least two valves, the first and second cylinder banks being arranged in a first V-shape about the engine plane and the third and fourth cylinder banks being arranged in a second V-shape about the engine plane, with the second cylinder bank being closer to the engine plane than the first cylinder bank;

at least one camshaft for controlling the at least two valves of the plurality of cylinders;

a crankshaft for receiving rods connected to the plurality of cylinders; and push rods on the first and second camshafts for controlling the at least two gas exchange valves;

wherein the at least one camshaft includes a first camshaft disposed on one side of the engine plane and a second camshaft disposed on another side of the engine plane.

* * * * *